United States Patent [19]

Vanderlinden

[11] Patent Number: 4,768,707

[45] Date of Patent: Sep. 6, 1988

[54] HUMIDIFIER FOR CONVECTION BASEBOARD HEATER

[76] Inventor: Roger Vanderlinden, 224 Rosewood Road, Hamilton, Ontario, Canada

[21] Appl. No.: 91,379

[22] Filed: Aug. 31, 1987

[51] Int. Cl.[4] ..... F24F 3/14

[52] U.S. Cl. ..... 237/78 A; 126/113

[58] Field of Search ..... 237/78 A, 78 B; 126/113

[56] References Cited

U.S. PATENT DOCUMENTS 1,601,810 10/1926 Rogge et al. .
3,598,311 8/1971 Lauffenburger .
4,284,129 8/1981 Rogalski .

FOREIGN PATENT DOCUMENTS 179002 11/1935 Switzerland ..... 237/78

*Primary Examiner*—Henry A. Bennett
*Attorney, Agent, or Firm*—Donald E. Hewson

[57] ABSTRACT

A humidification system for use with a baseboard style heater having a shallow, elongated convector casing, with extensive heat transfer surfaces therein, the system including a shallow evaporator tank combined with an external reservoir connected to the evaporator tank by way of a water level control. The evaporator tank is located above the fins and coils of the heater and has a deeply indented bottom portion to provide an extended heat transfer surface for rapidly heating a shallow layer of water within the evaporator tank. Convectional flow past the evaporator heat transfer surfaces is promoted by openings into the top of the evaporator. An adjustable cover on top of the evaporator regulates the air flow therethrough, and hence the degree of humidification.

11 Claims, 1 Drawing Sheet

HUMIDIFIER FOR CONVECTION BASEBOARD HEATER

BACKGROUND OF THE INVENTION

This invention is directed to a humidifier system, and in particular to a stationary evaporator tank having provision to be heated by a convector heater, using an external water supply.

Domestic humidification of the indoors during the heating season has received enormous attention in the past and has resulted in many varieties of moisture generators, with many and various ways of controlling the level of humidification achieved.

There are a number of problems involved in humidifying the air within a building, such as the presence of various salts and contaminants in solution in the feed water, and the concentration of dust and fluff around the heating means over a period of time, under the influence of convection air currents and associated air circulation.

One commonly used method to enhance the capacity of a system is the use of an evaporating wicking body, having air permeable, moisture wicking surfaces to achieve enhanced rates of evaporation as shown in U.S. Pat. Nos. 3,598,311 LAUFFENBURGER, issued Aug. 10, 1971 and 4,284,129 ROGALSKI, issued Aug. 18, 1981. A major disadvantage of such arrangements, particularly in "hard" water regions, is the precipitation and accumulation of the present salt materials out of solution onto the wicking surfaces, with consequent degradation, fouling and loss of effectiveness.

There has been a trend towards baseboard heating, both in individual homes and in apartment buildings having centralized heating plants. Such baseboard heating units generally comprise either hot water (or steam) circulation coils and electrical base board heaters. Most such heaters are characterized by their significant length, extending several feet along the base of a wall, hence the name; and possessing a low, narrow cross-sectional profile.

It is this characteristic profile which presents a number of difficulties that heretofore do not appear to have been overcome.

From an earlier age of water coil heaters that shared certain characteristics with present day hot water baseboard heaters, arrangements such as U.S. Pat. No. 1,601,810 ROGGE et al, issued Oct. 5, 1926 were provided, having an evaporator tank directly mounted on the coils, and being maintained at a predetermined water level by a reservoir tank located hereinabove. However, such an arrangement is unsuitable as a baseboard humidifier in that the structure of the evaporator and reservoir tanks constitute a major obstruction to upward conventional air circulation past the coils, with consequent loss in system effectiveness. Formerly, in ROGGE's times, this loss in effectiveness was compensated by over capacity of the radiators, which were generally large and bulky. These larger old-style radiators also transferred a significant portion of their output by radiation, hence their name. Furthermore, their operation was often continuous, in contrast to present-day heat-demand cycling.

One of the problems identified by the present inventors, for which a remedy has been provided, is the fact that heating by baseboard heaters generally is cyclic, which results in a short heat-up period, followed by an ensuing limited heating period, and an off-heat or "down" time in which energization of the heater unit, be it by hot water, steam, or electricity, is terminated.

Location of baseboard heaters is characteristically in the coldest locale of their environment, close to the floor and frequently below a window or other thermal discontinuity, in order to achieve maximum comfort, and effectiveness of function. Thus, during the off-heat periods, there is a significant cooling effect, such that the evaporator and its water content tend to be completely cooled off.

Thus, at the commencement of a heating cycle significant heat is required to bring the evaporator and its water content up to a vapour generating temperature.

In order to overcome the foregoing problems the present invention provides a humidifier system suitable for use with a baseboard type heater and posessing the following characteristics: wickless evaporation using a small, low profile section evaporator tank of relatively reduced length, permitting its selective location in a favourable location along the length of a baseboard heater. The low profile of the evaporator tank generally permits location of the evaporator tank directly on the fins of the baseboard heater, beneath the top grill of the heater. Furthermore the present invention provides an external reservoir, the system having a flow control to regulate the mass of water present in the evaporator and to limit its depth. This permits rapid warm-up and commencement of evaporation during the on-heat portion of a heating cycle. Furthermore, use of a flexible plastic feed pipe permits location of the reservoir in a concealed or other suitable access.

The system further provides in one preferred embodiment thereof a low mass, low specific heat, high conductivity evaporator tank, preferably of aluminum or an alloy thereof, to promote rapid warm-up to an effective temperature of vapourization.

The system further provides an evaporator tank having extended heat transfer areas, including air transfer passages to promote rapid warm-up and the substantially uninterrupted upward circulation of hot air in convectional heat transfer flow relation from a heated baseboard element therebeneath.

There is further provided means for selectively varying the depth of water within the evaporator tank, and adjustable tank cover means for selectively varying the output from the evaporator.

BRIEF DESCRIPTION OF THE DRAWINGS

Certain embodiments are described, reference being made to the accompanying drawings, wherein;

Referring to FIG. 1, a top grill portion 12 and portions of some of the convection plates 15 of a baseboard heater are shown, having the front cover portion thereof removed.

Figure 1:
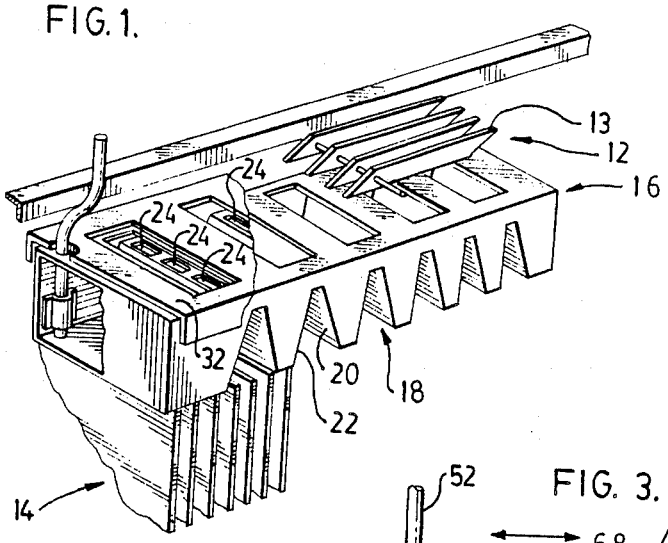
FIG. 1 is a general schematic view, in part section, of a preferred embodiment of the subject evaporator tank, in installed relation in a baseboard heater.
Figure 2:
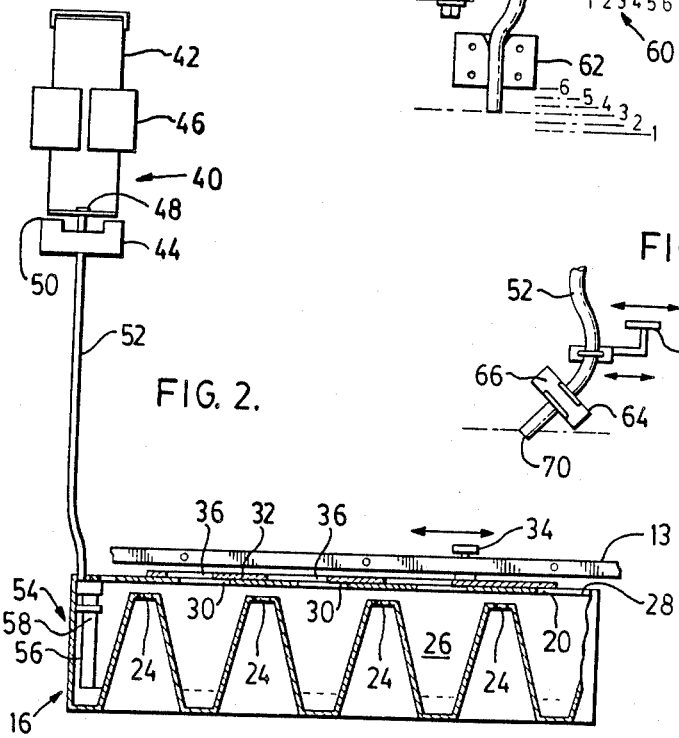
FIG. 2 is a schematic side elevation of the evaporator tank, water reservoir and a first depth control embodiment, in installed relation with a baseboard cover element.

An evaporator tank 16 in accordance with the present invention, as seen in FIGS. 1 and 2, has a deeply indented bottom portion 18, with upwardly convergent wall portions 20, 22 receiving rising hot air in heat exchange relation, from the convection plates 14 located therebeneath. It is important that the deep indentations in the bottom portion do not extend across the entire width of the bottom portion 18 of the evaporator tank 16 so as to preclude water passage throughout the entire bottom area of the tank.

The reason for having the deep indentations in the bottom portion 18 is to provide a greater contact surface area 19 with the water in the tray, for heating purposes. If the tray is flat-bottomed, the heat could be transferred to the water only at the bottom surface thereof and would be subsequently transferred to the upper portions of the water by the water itself. Since the tray is preferably made of aluminum, which has a heat transfer co-efficient much greater than water, the heat reaches a greater amount of water more quickly, which in turn heats the water more quickly.

A series of openings 24 permit transfer of the rising hot air into the interior 26 of tank 16. The tank 16 may be altered such as to increase or decrease the contact surface area 19 at the bottom portion 18 of the tank by making the deep indentations of different size, shape and quantity. Varying the contact surface area 19 at the bottom portion 18 of the tank 16 will affect the rate at which heat is transferred from the heater to the water in the tank, and will also affect the size of the area available for openings 24 that exist for the purpose of air flow. The exact size and shape of the deep indentations are merely design considerations, which can be chosen in order to adapt the unit to specific design parameters, without affecting the basic operation of the unit.

The tank 16 has a top portion 28, with a plurality of apertures 30 therein. In the illustrated embodiment, the apertures 30 are offset from the openings 24.

A longitudinally slideable vented cover 32 has a handle portion 34, to permit adjustment of the vents 36 relative to the underlying apertures 30, in accordance with the desired requirement for humidification, which increases with colder weather.

A water supply 40, FIG. 2, has a removable gravity feed reservoir 42 normally mounted in inverted relation on sump 44. Support brackets 46 secure the reservoir 42 in its inverted position. A spring loaded valve 48 in the closure cap of reservoir 42 connects the contents of reservoir 42 in free flowing relation with sump 44 when seated thereon. A peripheral annular seal 50 extends about valve 48 and is sandwiched in sealing relation between reservoir 42 and sump 44 when reservoir 42 is emplaced, to preclude leakage of water between the vessels, or the ingress of air into the interior of reservoir 44. The reservoir 42 may be readily removed, inverted, refilled and replaced, without leakage spills.

A water supply line 52 connects the sump 44 with the adjustable level controller 54.

In the embodiment shown in FIG. 2, a pipe 52 extends in sealed wall-to-wall relation within pipe 56. The pipe 56 is illustrated as having a plurality of threads 58 at the top and thereof, rotation thereof permitting vertical adjustment of the height of the outlet of the pipe 56.

Water flowing downwardly in the tube 52 flows through the pipe 56 until the floor of tank 16 is generally covered, depending on the geometry of the floor. The position of the outlet of pipe 56 determines the level of water therein.

The ability to adjust the amount of humidification delivered by the present invention is a function not only of the positioning of the vents 36, but also of the water level. The reason for this lies in the fact that the humidification process relies on the cyclic nature of the heater being used. When the heater first turns on, the water in the tank is at a cooler temperature than it ultimately will be at after the heater has been on for a period of time. As the heater temperature rises, the water temperature also rises to a point at which it can evaporate sufficiently so as to allow adequate humidification to take place. If the level of the water in the tank is low, thereby defining a small mass of water in the tank, the water can heat up relatively quickly. Therefore, by having the water level adjusted to a fairly low level, rapid humidification of a room is possible. It is also desireable to have the water reach humidification temperature quickly because the heater may only be on for a short period of time, due to the cyclic nature of heat systems.

Conversely, there are circumstances when a high water level in the tank may be desireable. A higher level of water provides a larger mass of water in the tank, which would of course heat up more slowly, but would also cool off more slowly when the heater turns off. As a result, humidification may continue for a longer period of time after the heater is turned off than if when there is a low level of water in the tank.

The adjustability of water level is important, therefore, because it allows for the optimal water level for the desired humidification conditions to be realized, depending on conditions of the room be humidified.

The water level rises over the outlet of pipe 56, thereby precluding the ingress of air upwardly through pipes 56 and 52 and thence into reservoir 42, by way of sump 44. A semi-vacuum, in that the guage pressure is negative with respect to the outside atmospheric pressure, then forms in the top space of reservoir 42. The relatively higher outside atmospheric pressure precludes the further release of water until the level in tank 16 subsides, to uncover the outlet of tube 56 and permit the entry of air thereto. The air then bubbles up within reservoir 42 and releases water into tank 16 until the pre-set level is again obtained.

Figure 3:
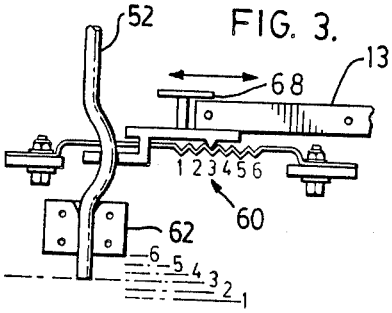
FIG. 3 is a schematic side view showing the elements of a second depth control.

In the FIG. 3 embodiment a rack and detent 60, illustrated as having six numbered positions, is hooked in transverse deforming relation with the tube 52, so as to withdraw it upwardly in sliding relation through the fixture 62.

The indicated six water levels correspond to the respective six positions of the adjustable rack and detent level control means 60. The level control handle 34 thereof extends upwardly through the vanes 13 of grill 12.

Figure 4:
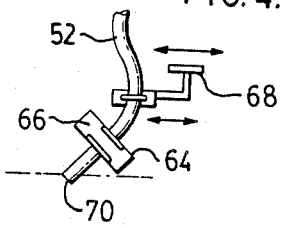
FIG. 4 is a scrap view of a third depth control embodiment, having a pivotable water outlet.

In the FIG. 4 embodiment the tube 52 is secured to a pivotal mount 64, pivotted at 66, whereby deformation of tube 52 by the hand control 68, in the manner shown in FIG. 3 displaces the lower end 70 of tube 52 upwardly, to change the setting of the water level to that illustrated.

It has been found in use of the subject arrangement that effective humidification can be obtained. The simple, accessible controls permit ready adjustment of the water level in the evaporator, so as to permit maintenance of low water level in the evaporator, which, allied with the low mass and low specific heat of the evaporator, together with large heat transfer surfaces and convector vents 24, optimizes the performance of the system, even for comparatively short heating cycles.

The simple, readily adjusted vented cover 32 permits adjustment, as of a damper, to the evaporator, for a wide range of humidification by the evaporator.

Also contemplated is an embodiment wherein the means for adjusting the water level in a tank 16, such as the adjustable level controller 54, works in conjunction with the slidable vented cover 32. The means for adjusting the water level could be physically connected to the slideable vented cover 32, such that adjusting the water level up or down, would close or open, respectively, the vents 36. When the water level is adjusted to a low level, a relatively large amount of water is evaporated into the air whenever the heater turns on and reaches a suitable temperature. In order to effect maximum room humidification from the water vapour, a relatively large volume of air flow would be required, thus necessitating the vents 36 to be opened fully.

Conversely, when the water level is adjusted to a high level, less water vapour is produced whenever the heater turns on, and correspondingly a smaller volume of air flow is required.

The simple construction, and integration of the controls 34 and 68 between the vanes 13 of grill 12, permits location of the humidifier at a most favourable location longitudinally of a baseboard heater, in terms both of convenience for positioning of the controls, and access thereto, and the avoidance of unduly cold spots such as beneath windows and the like, whereby the evaporator tank and its contents could otherwise be significantly chilled in off-heat periods of the heating cycle.

Typically the evaporator tank 16 would not exceed two feet in length, while the baseboard heater may readily be four times that length, and more.

Adoption of a through-vented evaporator tank permits the adoption of a low profile tank having the width thereof substantially equal to the corresponding width of the plates of an underlying convector heater.

I claim:

1. In a humidifier system having an evaporator tank of low profile for insertion, in use thereof, upon the convector plates of a convector heater, the improvement comprising; a series of openings in the bottom surfaces of the tank, the periphery of each opening being bounded by heat transfer surfaces extending upwardly through a liquid containing portion of the tank, for upward passage of hot air in heat exchange relation therewith, and means for admitting water to a predetermined level within the tank, said heat transfer surfaces having apertures at the upper end thereof for passage therethrough of hot air; and wherein said water admitting means includes selective adjustment means, in use to permit selective modulation of the level of water within said evaporator tank.

2. The system as set forth in claim 1, including air flow control means located at the top of said tank for controlling the outflow of hot air therefrom.

3. The system as set forth in claim 2, said air flow control means including air flow adjustment means for selectively modulating the flow of humidified air from the evaporator tank.

4. The system as set forth in claim 3, including stationary baffle means located in flow deflecting relation above said upper end apertures.

5. The system as set forth in claim 1 including demountable reservoir means to receive a reserve quantity of water therein, sump means connected by way of a tube with said evaporator tank, for transfer of water downwardly therethrough, and seal means securing said reservoir in inverted, sealed attachment to the sump means.

6. The system is set forth in claim 5 including valve means securing said reservoir in closed relation, said valve means being operative in co-operation with said sump means, upon application of said reservoir, in inverted relation, into sealing engagement with the reservoir, to open the valve means and release water from the reservoir, downwardly into the sump for passage to the evaporator tank.

7. The system as set forth in claim 1 said selective adjustment means including a water outlet pipe, and position adjustment means for varying the level thereof.

8. The system as set forth in claim 7, said adjustment means including threaded attachment means to vary said level on rotation of said attachment means.

9. The system as set forth in claim 8 said adjustment means including selectively variable tube deflection means connected in lateral deforming relation with said tube, in use to deform said tube and change the level of the tube outlet.

10. The system as set forth in claim 9, a lower end portion of said tube being pivotally mounted, for pivotal deflection thereof in height adjusting displacement of the tube outlet.

11. The system as set forth in claim 9, a lower end portion of said tube being slideably mounted for axial displacement thereof in height adjusting displacement of the tube outlet.

* * * * *